US010477625B2

(12) United States Patent
Blasco Rueda et al.

(10) Patent No.: US 10,477,625 B2
(45) Date of Patent: Nov. 12, 2019

(54) COOKING APPLIANCE

(71) Applicant: BSH Hausgeräte GmbH, Munich (DE)

(72) Inventors: Nicolas Blasco Rueda, Saragossa (ES); Alvaro Cortes Blanco, Saragossa (ES); Oscar Garcia-Izquierdo Gango, Saragossa (ES); Diego Puyal Puente, Saragossa (ES)

(73) Assignee: BSH Hausgeräte GmbH, Munich (DE)

( * ) Notice: Subject to any disclaimer, the term of this patent is extended or adjusted under 35 U.S.C. 154(b) by 422 days.

(21) Appl. No.: 15/126,608

(22) PCT Filed: Mar. 24, 2015

(86) PCT No.: PCT/IB2015/052127
§ 371 (c)(1),
(2) Date: Sep. 16, 2016

(87) PCT Pub. No.: WO2015/150967
PCT Pub. Date: Oct. 8, 2015

(65) Prior Publication Data

US 2017/0127479 A1 May 4, 2017

(30) Foreign Application Priority Data

Apr. 2, 2014 (ES) ..... 201430485

(51) Int. Cl.
*H05B 6/06* (2006.01)
*F24C 7/08* (2006.01)

(52) U.S. Cl.
CPC ..... *H05B 6/062* (2013.01); *F24C 7/081* (2013.01)

(58) Field of Classification Search
CPC ..... H05B 6/062; F24C 7/081
(Continued)

(56) References Cited

U.S. PATENT DOCUMENTS 4,823,112 A * 4/1989 Chen ..... G08B 1/08 340/393.3
2011/0233199 A1* 9/2011 Garcia Jimenez ..... H05B 6/065 219/661

(Continued)

FOREIGN PATENT DOCUMENTS

DE 3925467 A1 4/1990
DE 3925767 A1 * 4/1990 ..... H01H 47/04

OTHER PUBLICATIONS

International Search Report PCT/IB2015/052127 dated Jun. 24, 2015.

*Primary Examiner* — Thien S Tran
(74) *Attorney, Agent, or Firm* — Michael E. Tschupp; Andre Pallapies; Brandon G. Braun

(57) ABSTRACT

A cooking appliance apparatus includes at least one mechanical switch having at least one armature element and at least one driver coil, with the at least one driver coil being configured to at least initiate at least one switching operation of the at least one armature element. At least one mean coil voltage is supplied by at least one driver circuit configured for the at least one driver coil. A control unit supplies at least one control signal for controlling the at least one driver circuit. The control unit is configured to divide the at least one switching operation into at least one first time subrange and at least one second time subrange and to operate the at least one driver coil differently via the at least one driver circuit in the first and second time subranges.

21 Claims, 3 Drawing Sheets

(58) Field of Classification Search
USPC ..... 219/490, 492, 620, 622, 624, 661, 668
See application file for complete search history.

(56) References Cited

U.S. PATENT DOCUMENTS

| | | | | |
|---|---|---|---|---|
| 2013/0206750 | A1* | 8/2013 | Anton Falcon ..... | H05B 6/062<br>219/622 |
| 2014/0003099 | A1* | 1/2014 | Dillig ..... | H02M 5/458<br>363/37 |

* cited by examiner

COOKING APPLIANCE

CROSS-REFERENCES TO RELATED APPLICATIONS

This application is the U.S. National Stage of International Application No. PCT/IB2015/052127, filed Mar. 24, 2015, which designated the United States and has been published as International Publication No. WO 2015/150967 and which claims the priority of Spanish Patent Application, Serial No. P201430485 filed Apr. 2, 2014, pursuant to 35 U.S.C. 119(a)-(d).

BACKGROUND OF THE INVENTION

Cooktops comprising a relay with an armature element and a driver coil as well as a driver circuit, which is provided to supply a mean coil voltage for the driver coil, are known from the prior art. A control unit is provided here to operate the driver coil with a constant mean coil voltage during a switching operation of the armature element.

BRIEF SUMMARY OF THE INVENTION

The object of the invention is in particular to provide a generic cooking appliance apparatus with improved attributes in respect of switching speed and/or switching reliability. The object is achieved by the characterizing features of the independent claims, while advantageous embodiments and developments of the invention will emerge from the subclaims.

The invention is based on a cooking appliance apparatus, in particular a cooktop apparatus, with at least one mechanical switch, which has at least one armature element and at least one driver coil, which is provided at least for the purpose of initiating at least one switching operation of the at least one armature element, with at least one driver circuit, which is provided to supply at least one mean coil voltage for the at least one driver coil, and with a control unit, which is provided for the purpose of supplying at least one control signal for controlling the at least one driver circuit, in particular the at least one switching operation thereof.

It is proposed that the control unit is provided for the purpose of dividing the at least one switching operation, in particular the at least one switching operation from a normal state to a working state of the at least one mechanical switch, into at least one first time subrange and at least one second time subrange and operating the at least one driver coil differently by means of the at least one driver circuit in the at least two time subranges.

A "cooking appliance apparatus" refers in particular to at least a part, in particular a subassembly, of a cooking appliance, in particular of a cooktop and preferably of an induction cooktop. In particular the cooking appliance apparatus can also comprise the entire cooking appliance, in particular the entire cooktop and preferably the entire induction cooktop. The cooking appliance apparatus preferably comprises at least one inverter and at least one inductor, which is provided to be supplied with a high-frequency heating current from the at least one inverter. The high-frequency heating current is provided in particular to heat, in particular cookware, in particular by means of eddy current and/or magnetization change effects. "Provided" means in particular specifically programmed, designed and/or equipped. That an object is provided for a specific function means in particular that the object satisfies and/or performs said specific function in at least one application and/or operating state. The at least one mechanical switch is configured in particular as a contactor and/or preferably as a relay. In particular the at least one mechanical switch here can be configured as an on switch, in particular an SPST switch, DPST switch, SPCO switch and/or SPTT switch, and/or as a toggle switch, in particular an SPDT switch, DPDT switch and/or DPCO switch. The at least one mechanical switch is preferably arranged between the at least one inverter and the at least one inductor and is provided in particular to break and/or establish a least one conduction path between the at least one inverter and the at least one inductor in at least one operating state. A "conduction path" in this context refers in particular to an electrically conducting connection between at least two points. An "on switch" in this context refers in particular to a switch which in at least one operating state is provided for the purpose of establishing and/or isolating an electrical connection between at least two contacts of the switch and electrical insulation is present between all contacts of the switch in particular in a further operating state that is in particular different from the at least one operating state. A "toggle switch" refers in particular to a switch which has at least three contacts and is provided in particular for the purpose of establishing and/or isolating an electrically conducting connection between at least two of the at least three contacts depending on switching position. A "switching operation" refers in particular to an operation in which the at least one armature element of the at least one mechanical switch performs a movement and in which the at least one mechanical switch changes its switching state in particular. In particular the switching operation starts with a start of the movement and ends with renewed stoppage of the at least one armature element. The at least one switching operation preferably starts and ends in a time range with a duration of maximum 20 ms, preferably maximum 15 ms and particularly preferably maximum 10 ms. During the at least one switching operation the at least one mechanical switch is in particular in a non-conducting and/or bouncing state. In particular the at least one switching operation can comprise a release of at least one electrically conducting connection the at least one mechanical switch has in at least one operating state and/or an, in particular complete, establishing of at least one, in particular further, electrically conducting connection. A "normal state" refers in particular to a rest state of the at least one mechanical switch, in particular an NC (normally closed) state and/or an NO (normally open) state. In particular the at least one armature element has a conducting connection to a rest contact in the normal state. A "working state" in this context refers in particular to a state of the at least one mechanical switch, in which the at least one armature element is moved out of the rest state, in particular by a magnetic field generated by the at least one driver coil. In particular the at least one armature element has a conducting connection to a working contact in the working state and/or is free of a conducting connection. That the "at least one driver coil is provided for the purpose of initiating at least one switching operation of the at least one armature element" means in particular that the at least one driver coil is provided to generate at least one magnetic field, which is provided for the purpose of initiating at least one movement of the at least one armature element. A "mean coil voltage" refers in particular to an in particular temporally mean effective voltage, which is present at the at least one driver coil in at least one operating state. A "time subrange" in this context refers in particular to a part of the duration of the at least one switching operation. That the control unit is provided to "operate the at least one driver coil differently"

in the at least two time subranges means in particular that the control unit is provided for the purpose of operating the at least one driver coil in such a manner that at least one operating parameter is different in the at least two time subranges. This embodiment allows a generic cooking appliance apparatus to be provided with improved attributes in respect of switching speed and/or switching reliability. In particular it allows a switching speed of the at least one switching operation of the at least one mechanical switch to be increased and a temperature dependence of the at least one mechanical switch to be advantageously minimized Efficiency can also advantageously be increased. Spontaneous heating of the at least one mechanical switch can also be reduced and costs can be minimized.

The at least one second time subrange preferably follows the at least one first time subrange directly from a time perspective. That two time ranges "follow one another directly from a time perspective" means in particular that the two time ranges are directly one after the other at least from a time perspective and in particular have at least one common time point. The sum of the at least one first time subrange and the at least one second time subrange preferably corresponds to an overall duration of the at least one switching operation. This allows an efficient switching operation to be advantageously achieved.

If the at least one first time subrange includes at least one acceleration, in particular an acceleration from a rest position and/or a start of a movement, of the at least one armature element, acceleration of the at least one switching operation in particular can be simplified.

The at least one second time subrange advantageously includes at least one springing of the at least one armature element. If the at least one mechanical switch is configured as an on switch, "springing" of the at least one armature element refers in particular to a bouncing of at least two contacts of the at least one mechanical switch and/or a state, in which the at least one mechanical switch transitions from an NC (normally closed) state to an opened state and can execute in particular spring oscillations there. If the at least one mechanical switch is configured as a toggle switch, the term "springing" refers in particular to a bouncing of at least two contacts of the at least one switch. This allows an advantageously simple switching operation in particular to be achieved.

It is further proposed that the control unit is provided for the purpose of operating the at least one driver coil with a higher mean coil voltage in the at least one first time subrange than in the at least one second time subrange. In particular during at least one time point of the at least one first time subrange and preferably during a part of the at least one first time subrange, which makes up in particular at least 30%, preferably at least 50% and particularly advantageously at least 70% of the at least one first time subrange, the at least one driver coil has a higher coil voltage than during at least one time point of the at least one second time subrange and preferably during a part of the at least one second time subrange, which makes up in particular at least 30%, preferably at least 50% and particularly advantageously at least 70% of the at least one second time subrange. The mean coil voltage preferably reaches a stationary state within the at least one first time subrange and within the at least one second time subrange, with a voltage level of the stationary state of the at least one first time subrange having a higher value than a voltage level of the stationary state of the at least one second time subrange. A "higher mean coil voltage" here refers in particular to a mean coil voltage, which is at least 5%, advantageously at least 10%, preferably at least 15% and particularly preferably at least 25% greater than a reference voltage. This allows an advantageously fast switching operation in particular to be achieved.

In one embodiment of the invention it is proposed that the at least one driver circuit has a voltage supply unit for supplying the at least one driver coil and in at least one operating state the control unit is provided for the purpose of varying at least one output voltage of the voltage supply unit. A "voltage supply unit" in this context refers in particular to a unit which is provided for the purpose of supplying at least one potential that is different from a ground potential at at least one connector. The voltage supply unit here preferably has at least one control connector, in particular at least one input connector and at least one output connector. The voltage supply unit is preferably provided for the purpose of supplying a higher output voltage than input voltage. The voltage supply unit could for example have at least one switch and/or be configured as a switch. In this instance the at least one switch could be provided in at least one operating state to connect the at least one driver circuit to at least one of at least two network parts and/or at least one of at least two outputs of at least one network part. This allows in particular operation of the at least one driver circuit and/or a mean coil voltage to be varied in an advantageously simple manner.

The voltage supply unit could comprise for example at least one rectifier, in particular an AC/DC converter. The voltage supply unit preferably has at least one DC converter, in particular a DC/DC converter, and is preferably configured as a DC converter. The DC converter can be configured in particular as a flyback converter, forward converter, push-pull converter, resonant converter, multiphase converter, bridgeless PFC converter, step-down converter, step-up converter, buck-boost converter, synchronous converter, SEPIC converter, Cuk converter, zeta converter, double inverter, split-pi converter, cascaded step-down converter, cascaded step-up converter and/or preferably as a positive and/or negative charge pump. This particularly advantageously allows operation of the at least one driver circuit and/or a mean coil voltage to be varied.

It is further proposed that the at least one control signal is a pulse width modulated signal. In particular the pulse width modulated signal can have different duty factors for different time ranges, in particular for the at least one first time subrange and the at least one second time subrange. A "duty factor" here refers in particular to a ratio of a time period, during which a, preferably periodic, control signal of the control unit has an on value, in particular a high level, to a defined time range, preferably a cycle duration of the control signal. An in particular temporarily constant control signal, which only has a high level at least in the defined time range, in particular has a duty factor of 1. Also an in particular temporarily constant control signal, which only has a low level in the defined time range, has a duty factor of 0. This allows in particular simple and advantageously efficient activation of the at least one mechanical switch.

In one preferred embodiment of the invention it is proposed that the at least one control signal has at least two different duty factors during the at least one switching operation. This allows in particular an efficient and advantageously fast switching operation to be achieved. An advantageously simple control algorithm can also be supplied.

It is further proposed that in at least one operating state, in particular at least during the at least one first time subrange, the control unit is provided for the purpose of increasing the mean coil voltage at least temporarily, preferably at least during the entire at least one first time subrange, above a normal voltage value, in particular a rated voltage value, of the at least one driver coil. In this context a "normal voltage value" refers in particular to a minimum voltage value, which is required to initiate and/or perform a switching operation of the at least one mechanical switch. A "rated voltage value" refers in particular to an in particular optimum voltage value, in particular as predefined by a manufacturer, which is required to initiate and/or perform a switching operation of the at least one mechanical switch, in particular as efficiently and/or quickly as possible. In at least one further operating state, that is in particular different from the at least one operating state, in particular at least during the at least one second time subrange, the control unit is provided for the purpose of operating the at least one driver coil with the normal voltage value and/or the rated voltage value. The expression that the "control unit is provided for the purpose of increasing the mean coil voltage above a normal voltage value" here means in particular that a value of the mean coil voltage is at least 5%, advantageously at least 10%, preferably at least 15% and particularly preferably at least 25% greater than the normal voltage value. The control unit is preferably provided for the purpose of increasing the mean coil voltage at least temporarily to double the normal voltage value and/or the rated voltage value. This allows a switching speed to be increased in particular in an advantageously simple and in particular efficient manner.

An inventive method is based on a method for operating a cooking appliance apparatus, in particular a cooktop apparatus, with at least one mechanical switch, which has at least one armature element and at least one driver coil, which is provided for the purpose of initiating at least one switching operation of the at least one armature element, and with at least one driver circuit, which is provided to supply at least one mean coil voltage for the at least one driver coil.

It is proposed that the at least one switching operation is divided into at least one first time subrange and at least one second time subrange and the at least one driver coil is operated differently by means of the at least one driver circuit in the at least two time subranges. This in particular increases the switching speed and/or switching reliability of the at least one switching operation of the at least one mechanical switch and advantageously minimizes the temperature dependence of the at least one mechanical switch.

BRIEF DESCRIPTION OF THE DRAWINGS

Further advantages will emerge from the description of the drawing which follows. The drawing shows exemplary embodiments of the invention. The drawing, description and claims contain numerous features in combination. The person skilled in the art will expediently also consider the features individually and combine them in useful further combinations.

DETAILED DESCRIPTION OF EXEMPLARY EMBODIMENTS OF THE PRESENT INVENTION

Figure 1:
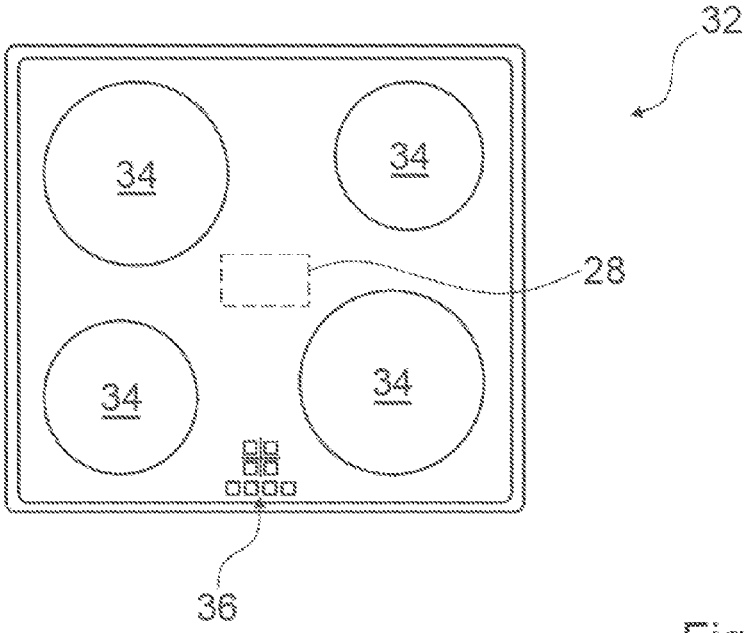
FIG. 1 shows a top view of a cooking appliance configured as an induction cooktop with four heating zones and a cooking appliance apparatus.

FIG. 1 shows a schematic top view of an exemplary cooking appliance 32 configured as an induction cooktop. In the present instance the cooking appliance 32 has a cooktop plate with four heating zones 34. Each heating zone 34 is provided to heat just one cookware element (not shown). The cooking appliance 32 also comprises a cooking appliance apparatus. The cooking appliance apparatus has an operating unit 36. The operating unit 36 allows a user to input and/or select a power stage. The cooking appliance apparatus has a control unit 28 for controlling a heating power. The control unit 28 has a computation unit, a storage unit and an operating program stored in the storage unit, which is provided to be executed by the computation unit.

Figure 2:
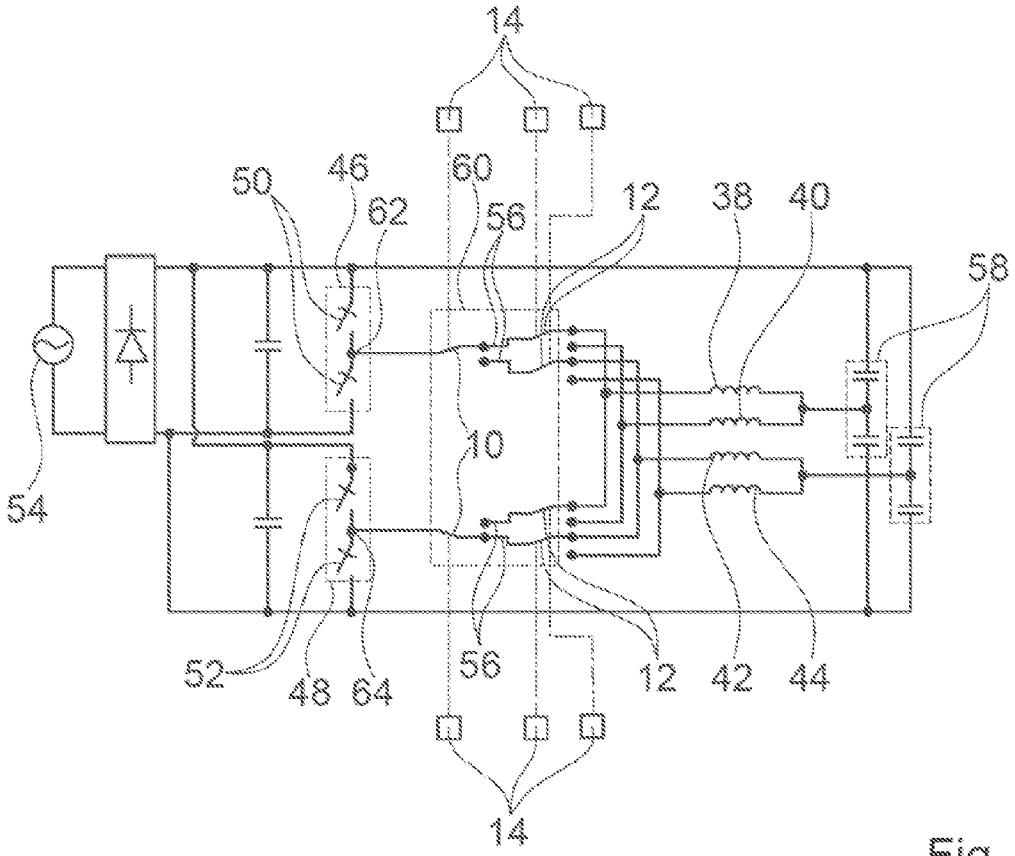
FIG. 2 shows a schematic circuit diagram of the cooking appliance apparatus with six mechanical switches.

FIG. 2 shows a schematic circuit diagram of the cooking appliance apparatus. The cooking appliance apparatus has four inductors 38, 40, 42, 44. Each inductor 38, 40, 42, 44 is assigned to one of the heating zones 34. The cooking appliance apparatus further comprises two inverters 46, 48. The inverters 46, 48 are configured identically to one another. Each inverter 46, 48 has two semiconductor switches 50, 52, in particular IGBTs. The control unit 28 is connected (not shown) to control connectors of the semiconductor switches 50, 52. Each of the inverters 46, 48 is provided to convert a pulsing rectified network voltage of an energy source 54 to a high-frequency heating current and in particular to supply it to at least one of the inductors 38, 40, 42, 44. To this end the cooking appliance apparatus has a number of conduction paths 56. In the present instance each of the inverters 46, 48 is connected to the inductors 38, 40, 42, 44 by way of conduction paths 56. The cooking appliance apparatus also has two resonance units 58. Each of the resonance units 58 is part of an electric oscillating circuit and can be charged by way of the associated inverter 46, 48.

The cooking appliance apparatus also has a switching arrangement 60. The switching arrangement 60 comprises a number of mechanical switches 10, 12. The mechanical switches 10, 12 are provided to break and/or establish the conduction paths 56 between the inverters 46, 48 and the inductors 38, 40, 42, 44. In the present instance the switching arrangement 60 comprises six mechanical switches 10, 12. The mechanical switches 10, 12 are of identical structure. The mechanical switches 10, 12 are configured as toggle switches. The mechanical switches 10, 12 are configured as relays in the present instance. Each of the conduction paths 56 can be broken by two mechanical switches 10, 12. Two first mechanical switches 10 are connected respectively to a heating current output 62, 64 of the inverters 46, 48. The two first mechanical switches 10 are also connected respectively to two second mechanical switches 12. The two second mechanical switches 12 are connected respectively to one of the inductors 38, 40, 42, 44.

The cooking appliance apparatus also has a number of driver circuits 14. Each driver circuit 14 is provided to activate one of the mechanical switches 10, 12. In the present instance the driver circuits 14 are configured identically to one another. One of the driver circuits 14 is assigned to each of the mechanical switches 10, 12. Each of the mechanical switches 10, 12 is connected to one of the driver circuits 14. Alternatively it is also conceivable to configure at least one driver circuit differently. Also a single driver circuit could be assigned to at least two mechanical switches.

The cooking appliance apparatus can also comprise further units, for example rectifiers, filters, detectors, in particular current detectors and/or voltage detectors, and or voltage converters.

Figure 3:
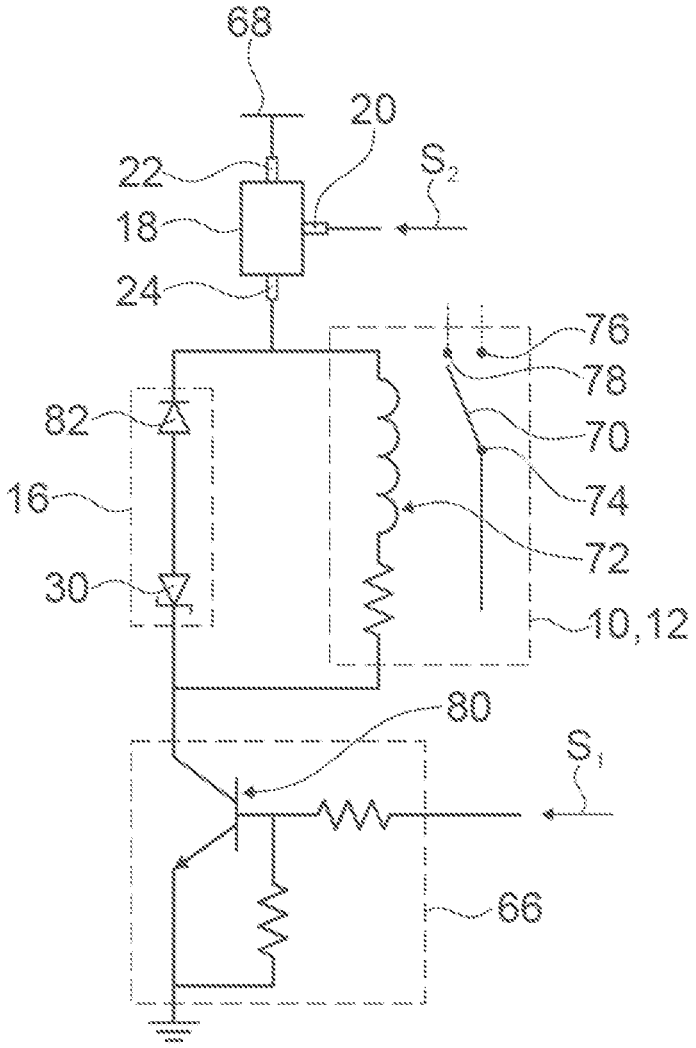
FIG. 3 shows a schematic circuit diagram of one of the mechanical switches and a driver circuit for activating the mechanical switch.

FIG. 3 shows an exemplary schematic circuit diagram of one of the mechanical switches 10, 12 and one of the driver circuits 14 from FIG. 2. The description which follows is based on the example of one of the mechanical switches 10, 12 and can in particular be applied to the other mechanical switches 10, 12 as well as the assigned driver circuits 14.

The mechanical switch 10, 12 has an armature element 70. The armature element 70 is made of a ferromagnetic material. The mechanical switch 10, 12 also has a driver coil 72. The driver coil 72 is provided to initiate at least one switching operation of the armature element 70. In the present instance the driver coil 72 has a ferromagnetic core. Alternatively a driver coil can also be configured without a ferromagnetic core and/or have a core of a different material. In at least one operating state the driver coil 72 is provided to attract the armature element 70, in particular by means of a magnetic force. The mechanical switch 10, 12 has three contacts. A first contact is configured as a switching contact 74. The switching contact 74 is connected indirectly and/or directly to one of the two heating current outputs 62, 64. A second contact is configured as a rest contact 76. The rest contact 76 is connected indirectly and/or directly to one of the inductors 38, 40, 42, 44. A third contact is configured as a working contact 78. The working contact 78 is connected indirectly and/or directly to one of the inductors 38, 40, 42, 44.

In the present instance the driver circuit 14 is provided for the purpose of supplying a mean coil voltage for the driver coil 72. The driver circuit 14 comprises a driver unit 66. The driver unit 66 has three connectors. The driver circuit 14 also has a protection unit 16. The protection unit 16 is provided to protect the mechanical switch 10, 12 from overvoltage. The protection unit 16 is also provided to protect the driver unit 66 from overvoltage. The protection unit 16 has three connectors.

The driver circuit 14 also has a voltage supply unit 18. The voltage supply unit 18 is provided to supply the at least one driver coil 72. In the present instance the voltage supply unit 18 is configured as a DC converter. The voltage supply unit 18 here is configured as a positive charge pump. The voltage supply unit 18 has three connectors 20, 22, 24. In the present instance the voltage supply unit 18 has a control connector 20, an input connector 22 and an output connector 24. Alternatively a voltage supply unit can also have a different number of control connectors, input connectors and/or output connectors. For example a voltage supply unit could have two input connectors and/or output connectors.

The cooking appliance apparatus also has a network part (not shown). The network part is provided for the purpose of providing an energy supply for the cooking appliance apparatus. In the present instance the network part is connected to the energy source 54. Alternatively it is also conceivable to connect a network part to a different, in particular separate, energy source. A network part connector 68 is also connected to the driver circuit 14. The mechanical switch 10, 12 is also connected to the driver circuit 14. To this end the mechanical switch 10, 12 has two connectors.

The network part connector 68 is connected to the input connector 22 of the voltage supply unit 18. The control connector 20 of the voltage supply unit 18 is connected to the control unit 28. The output connector 24 of the voltage supply unit 18 is connected to a first connector of the driver coil 72. The output connector 24 of the voltage supply unit 18 is also connected to a first connector of the protection unit 16.

The first connector of the driver coil 72 is connected to a first connector of the protection unit 16. A second connector of the driver coil 72 is also connected to a second connector of the protection unit 16. The protection unit 16 is therefore connected parallel to the driver coil 72. The second connector of the driver coil 72 is connected to a first connector of the driver unit 66. The second connector of the protection unit 16 is connected to the first connector of the driver unit 66. A second connector of the driver unit 66 is connected to the control unit 28. A third connector of the driver unit 66 is also connected to a ground connector. Alternatively or additionally a third connector of a driver unit can also be grounded.

The driver unit 66 has at least one control switch 80. In the present instance the control switch 80 is configured as a bipolar transistor. The control switch 80 is connected to the second connector of the driver unit 66 with a base contact by way of a resistor. The control switch 80 is also connected to the ground connector with an emitter contact. The control switch 80 is connected to the first connector of the driver unit 66 with a collector contact. The driver unit 66 can also have at least one further component, for example in particular at least one electrical resistor and/or at least one capacitor.

The protection unit 16 has a freewheeling diode 82. The protection unit 16 also has a consumer unit 30. In the present instance the consumer unit 30 is configured as a Zener diode. Alternatively a consumer unit could also be configured as a resistor. The freewheeling diode 82 is connected to the first connector of the protection unit 16 with a cathode contact. The consumer unit 30 is connected to the second connector of the protection unit 16 with a first contact, in particular a cathode contact. The consumer unit 30 is also connected to an anode contact of the freewheeling diode 82 with a second contact, in particular an anode contact. Alternatively it is also conceivable for a protection unit to have at least one switch, at least one resistor, preferably a temperature-dependent resistor, at least one safety fuse, at least one RC element, in particular a snubber element and/or a Boucherot element, and/or at least one varistor, in particular instead of a freewheeling diode and/or a consumer unit.

The control unit 28 is provided to supply control signals $S_1$, $S_2$ for controlling the driver circuit 14. In the present instance the control unit 28 is provided for the purpose of supplying two control signals $S_1$, $S_2$ for controlling the driver circuit 14. A first control signal $S_1$ here is a pulse width modulated signal. The first control signal $S_1$ here is present at the second connector of the driver unit 66. A second control signal $S_2$ is also a pulse width modulated signal. The second control signal $S_2$ here is present at the control connector 20 of the voltage supply unit 18. Alternatively it is also conceivable for at least one control signal to be a constant signal.

The control unit 28 is also provided to divide at least one switching operation of the armature element 70 into a first time subrange $t_a$ and a second time subrange $t_b$ and to operate the driver coil 72 differently, in particular with an at least essentially different mean coil voltage, by means of the driver circuit 14 in the two time subranges $t_a$, $t_b$.

In the present instance the control unit 28 is provided for the purpose of changing a mean potential present at the first connector of the driver coil 72 during the at least one switching operation. The control unit 28 is thus provided for the purpose of varying an output voltage of the voltage supply unit 18, in particular by means of the second control signal $S_2$. This allows the mean coil voltage of the driver coil 72 to be varied, in particular in the first time subrange $t_a$ and the second time subrange $t_b$. Alternatively and/or additionally a control unit can also be provided for the purpose of changing a mean potential present at a second connector of a driver coil during at least one switching operation, in particular by means of a first control signal. Alternatively it is also conceivable for a control unit to be provided for the purpose of changing both a mean potential present at a first connector of the driver coil and a mean potential present at a second connector of a driver coil during at least one switching operation.

A mode of operation of the cooking appliance apparatus is described below with reference to FIG. 4.

Figure 4:
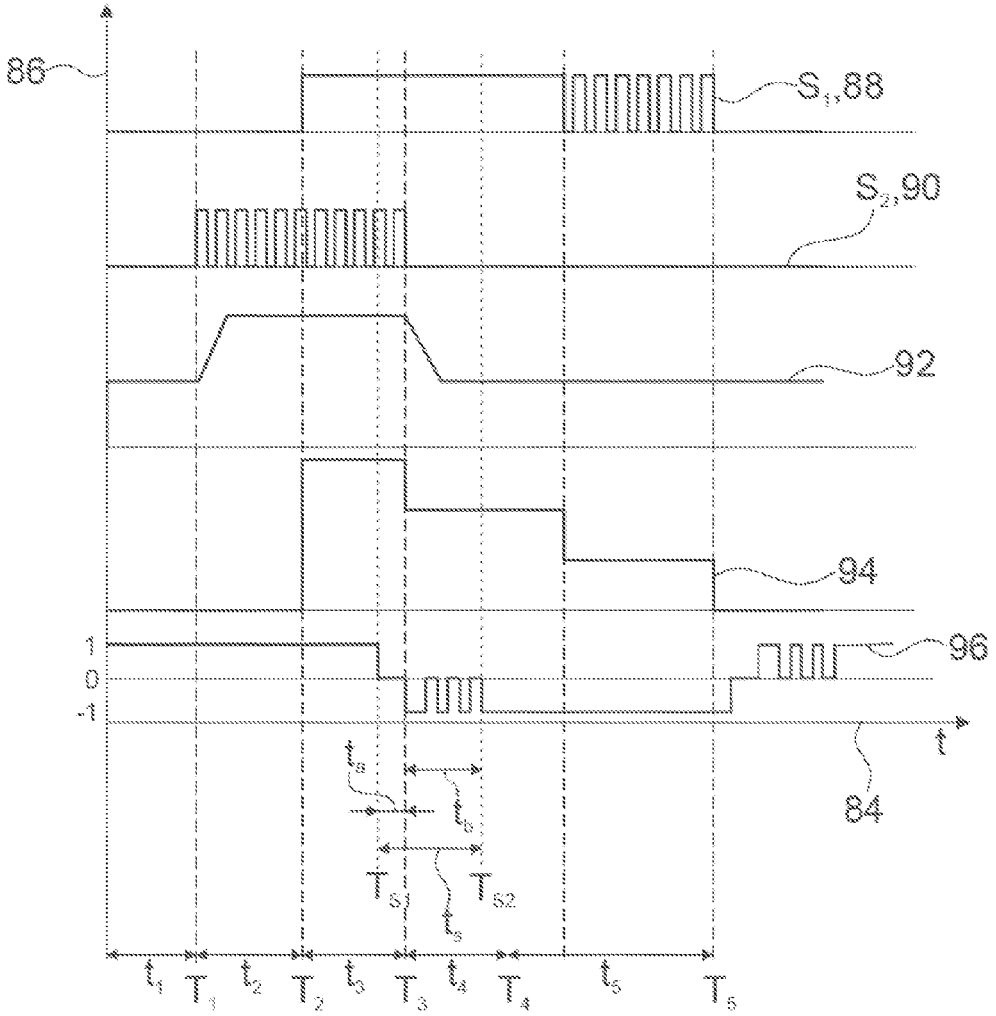
FIG. 4 shows a schematic diagram of different signals for controlling a switching state of the at least one mechanical switch.

FIG. 4 shows a schematic diagram (in particular not to scale) of different signals for controlling a switching operation of the mechanical switch 10, 12. The time is shown on an x-axis 84. A y-axis 86 is the variable axis. A curve 88 shows the first control signal $S_1$ supplied by the control unit 28. The first control signal $S_1$ here can have at least one high level and at least one low level. A curve 90 shows the second control signal $S_2$ supplied by the control unit 28. The second control signal $S_2$ here can have at least one high level and at least one low level. A curve 92 shows the output voltage of the voltage supply unit 18 and therefore the electrical potential present at the output connector 24. A curve 94 shows a schematic representation of the mean coil voltage of the driver coil 72. A curve 96 illustrates the switching states of the mechanical switch 10, 12. A "1" level defines a conducting connection between the switching contact 74 and the rest contact 76 of the mechanical switch 10, 12. A "−1" level here defines a conducting contact between the switching contact 74 and the working contact 78 of the mechanical switch 10, 12. A "0" level defines a non-conducting state.

During a first time interval $t_1$ the two control signals $S_1$, $S_2$ have the low level. In this instance a duty factor of the control signals $S_1$, $S_2$ has value of 0. In this operating state a potential of 24 V is present at the output connector 24 of the voltage supply unit 18. In the present instance this potential value corresponds to a normal voltage value of the driver coil 72. The normal voltage value here is a rated voltage value of the driver coil 72 used in this instance as predefined by a manufacturer. Alternatively a normal voltage value can also have any other value, in particular depending on the driver coil used. The control switch 80 is also open and therefore non-conducting. The driver coil 72 is therefore free of current in this instance. The switching contact 74 of the mechanical switch 10, 12 is also connected to the rest contact 76 of the mechanical switch 10, 12 in a conducting manner.

At a time point $T_1$ the second control signal $S_2$ changes. During a second time interval $t_2$ the first control signal $S_1$ has the low level. During the second time interval $t_2$ the second control signal $S_2$ has a duty factor with a value of 0.5. Alternatively a second control signal can also have any other duty factor. In this operating state the potential at the output connector 24 of the voltage supply unit 18 rises to 48 V. The potential at the output connector 24 of the voltage supply unit 18 is therefore essentially 48 V during the second time interval $t_2$. In the present instance this potential corresponds to double the normal voltage value of the driver coil 72. The control switch 80 is also open and therefore non-conducting. The driver coil 72 is then without current. The switching contact 74 of the mechanical switch 10, 12 is also connected to the rest contact 76 of the mechanical switch 10, 12 in a conducting manner. The second time interval $t_2$ has a duration of at least 1 ms. In the present instance the second time interval $t_2$ has a duration of 10 ms.

At a time point $T_2$ the first control signal $S_1$ changes. Therefore in the present instance the first control signal $S_1$ changes 10 ms after the second control signal $S_2$. During a third time interval $t_3$ the first control signal $S_1$ has the high level. Therefore during the third time interval $t_3$ the first control signal $S_1$ has duty factor with a value of 1. During the third time interval $t_3$ the second control signal $S_2$ has the duty factor with a value of 0.5. During the third time interval $t_3$ the potential at the output connector 24 of the voltage supply unit 18 is 48 V. The control switch 80 is also closed and therefore conducting. A switching current therefore flows through the driver coil 72. The switching current flows through the driver coil 72 and the control switch 80 to the ground connector. In this process the driver coil 72 generates a magnetic field, which is provided to attract the armature element 70. In this instance a mean coil voltage of 48 V is present between the first connector of the driver coil 72 and the second connector of the driver coil 72. The third time interval $t_3$ has a duration of at least 6 ms. In the present instance the third time interval $t_3$ has a duration of 10 ms.

At a time point $T_3$ the second control signal $S_2$ changes. During a fourth time interval $t_4$ the first control signal $S_1$ has a duty factor with a value of 1. During the fourth time interval $t_4$ the second control signal $S_2$ has the duty factor with a value of 0. In this operating state the potential at the output connector 24 of the voltage supply unit 18 drops to 24 V. The potential at the output connector 24 of the voltage supply unit 18 is therefore essentially 24 V during the fourth time interval $t_4$. The control switch 80 is also closed and therefore conducting. A switching current therefore flows through the driver coil 72. In this instance a mean coil voltage of essentially 24 V is present between the first connector of the driver coil 72 and the second connector of the driver coil 72. In the present instance the fourth time interval $t_4$ has a duration of 90 ms.

A switching operation takes place in a time range $t_S$. The time range $t_S$ lies in the region of the third time interval $t_3$ and the fourth time interval $t_4$ and overlaps the two time intervals $t_3$, $t_4$ at least partially. The switching operation and/or the time range $t_S$ can have a duration between 1 ms and 20 ms. The switching operation and/or the time range $t_S$ in the present instance has a duration of 10 ms. The control unit 28 is preferably provided for the purpose of deactivating the inverters 46, 48 at least during the switching operation. The switching operation starts at a time point $T_{S1}$. The time point $T_{S1}$ lies within the third time interval $t_3$. The switching operation ends at a time point $T_{S2}$. Bouncing of the mechanical switch 10 is fully terminated by the time point $T_{S2}$. The time point $T_{S2}$ lies within the fourth time interval $T_4$. The armature element 70 changes position here so that the switching contact 74 is connected to the working contact 78 in a conducting manner. The control unit 28 here is provided for the purpose of dividing the switching operation of the armature element 70, in particular the time range $t_S$, into a first time subrange $t_a$ and a second time subrange $t_b$. The first time subrange $t_a$ lies within the third time interval $t_3$. The second time subrange $t_b$ lies within the fourth time interval $t_4$. The second time subrange $t_b$ therefore follows directly after the first time subrange $t_a$ from a time perspective.

During the first time subrange $t_a$ the first control signal $S_1$ has the duty factor with a value of 1. During the first time subrange $t_a$ the second control signal $S_2$ has the duty factor with a value of 0.5. During the first time subrange $t_a$ the potential at the output connector 24 of the voltage supply unit 18 is 48 V. The control switch 80 is also closed and therefore conducting. A switching current flows through the driver coil 72. A mean coil voltage of 48 V is therefore present between the first connector of the driver coil 72 and the second connector of the driver coil 72. The control unit here is provided for the purpose of increasing the mean coil voltage at least temporarily above a normal voltage value of the driver coil 72, in particular above 24 V. The first time subrange $t_a$ here includes at least one release and one acceleration of the armature element 70.

At the time point $T_3$ the armature element 70 is in a non-conducting state. During the second time subrange $t_b$ the first control signal $S_1$ has the duty factor with a value of 1. During the second time subrange $t_b$ the second control signal $S_2$ has the duty factor with a value of 0. In this operating state the potential at the output connector 24 of the voltage supply unit 18 drops to 24 V. The potential at the output connector 24 of the voltage supply unit 18 is therefore essentially 24 V during the second time subrange $t_b$. The control switch 80 is also closed and therefore conducting. A switching current therefore flows through the driver coil 72. Therefore a mean coil voltage of essentially 24 V is present between the first connector of the driver coil 72 and the second connector of the driver coil 72. The second time subrange $t_b$ here includes at least one springing of the armature element 70. In the present instance the second time subrange $t_b$ includes at least one bouncing of the armature element 70. The control unit is therefore provided for the purpose of operating the driver coil with a higher mean coil voltage in the first time subrange $t_a$ than in the second time subrange $t_b$. In the present instance the second control signal $S_2$ also has two different duty factors, in particular 0.5 and 0, during the switching operation, in particular during the time range $t_S$.

In the present instance the time point $T_3$ is determined from empirical data and therefore corresponds in particular to a value based on experience. In the present instance the time point $T_3$ is 10 ms after the time point $T_2$ from a time perspective. The control unit 28 is therefore provided for the purpose of adjusting a position of the time intervals $t_3$, $t_4$, such that the first time subrange $t_a$ lies in the region of the third time interval $t_3$ and the second time subrange $t_b$ lies in the region of the fourth time interval $t_4$. Alternatively it is also conceivable for a cooking appliance apparatus to comprise at least one sensor unit, which is provided for the purpose of detecting a presence and/or absence of a conducting connection of at least one mechanical switch, and therefore in particular a time point $T_3$.

At a time point $T_4$ the first control signal $S_1$ changes. A duty factor of the first control signal $S_1$ here has a value of 0.7. During an entire fifth time interval $t_5$ the first control signal $S_1$ has the duty factor with the value 0.7. The first control signal $S_1$ also has a frequency of 25 kHz. During the fifth time interval $t_5$ the second control signal $S_2$ has the duty factor with a value of 0. In this operating state the potential at the output connector 24 of the voltage supply unit 18 is 24 V. The control switch 80 is also closed and opened alternately. In this holding state the first control signal $S_1$ causes a mean current to flow through the drive coil 72. The mean current here corresponds to an, in particular minimum, required holding current. In this instance a mean coil voltage of essentially 17 V is present between the first connector of the driver coil 72 and the second connector of the driver coil 72. This allows the armature element 70 to be held against the working contact 78. The switching contact 74 here is connected to the working contact 78 in a conducting manner. This increases efficiency and reduces spontaneous heating of the mechanical switch 10, 12.

At a time point $T_5$ the first control signal $S_1$ changes and has the low level. In this off state the control switch 80 is open and therefore non-conducting. In this instance the protection unit 16 is provided for the purpose of reducing the resulting induction voltage. A circular current produced by the induction voltage flows through the consumer unit 30, the freewheeling diode 82 and the driver coil 72. This allows any energy in the driver coil to be reduced effectively and in particular quickly, allowing any thermal dependence of the mechanical switch 10, 12 to be reduced. The energy of the driver coil 72 is reduced after around 1.5 ms to 2 ms. A second switching operation also takes place. The armature element 70 changes position so that the switching contact 74 is connected to the rest contact 76 in a conducting manner.

REFERENCE CHARACTERS

10 Switch
12 Switch
14 Driver circuit
16 Protection unit
18 Voltage supply unit
20 Control connector
22 Input connector
24 Output connector
28 Control unit
30 Consumer unit
32 Cooking appliance
34 Heating zone
36 Operating unit
38 Inductor
40 Inductor
42 Inductor
44 Inductor
46 Inductor
48 Inverter
50 Semiconductor switch
52 Semiconductor switch
54 Energy source
56 Conduction path
58 Resonance unit
60 Switching arrangement
62 Heating current output
64 Heating current output
66 Driver unit
68 Network part connector
70 Armature element
72 Driver coil
74 Switching contact
76 Rest contact
78 Working contact
80 Control switch
82 Freewheeling diode
84 x-axis
86 y-axis
88 Curve
90 Curve
92 Curve
94 Curve
96 Curve
$S_1$ Control signal
$S_2$ Control signal
$t_1$ Time interval
$t_2$ Time interval
$t_3$ Time interval
$t_4$ Time interval
$t_5$ Time interval $t_S$ Time range
$t_a$ Time subrange
$t_b$ Time subrange
$T_1$ Time point
$T_2$ Time point
$T_3$ Time point
$T_4$ Time point
$T_5$ Time point
$T_{S1}$ Time point
$T_{S2}$ Time point

The invention claimed is:

1. A cooking appliance apparatus, comprising:

at least one mechanical switch including at least one armature element and at least one driver coil, said at least one driver coil being configured to at least initiate at least one switching operation of the at least one armature element;

at least one driver circuit configured to supply at least one mean coil voltage for the at least one driver coil; and a control unit configured to supply at least one control signal for controlling the at least one driver circuit, said control unit being configured to divide the at least one switching operation into at least one first time subrange and at least one second time subrange and to operate the at least one driver coil differently via the at least one driver circuit in the first and second time subranges, wherein the at least one armature element bounces between an open state and a closed state a plurality of times in the at least one second time subrange.

2. The cooking appliance apparatus of claim 1, constructed as a cooktop apparatus.

3. The cooking appliance apparatus of claim 1, wherein the at least one second time subrange follows the at least one first time subrange directly from a time perspective.

4. The cooking appliance apparatus of claim 1, wherein the at least one first time subrange includes at least one acceleration of the at least one armature element.

5. The cooking appliance apparatus of claim 1, wherein the control unit is configured to operate the at least one driver coil in the at least one first time subrange with a mean coil voltage which is higher than a mean coil voltage in the at least one second time subrange.

6. The cooking appliance apparatus of claim 1, wherein the at least one driver circuit has a voltage supply unit for supplying the at least one driver coil, said control unit being configured to vary in at least one operating state at least one output voltage of the voltage supply unit.

7. The cooking appliance apparatus of claim 6, wherein the voltage supply unit has at least one DC converter.

8. The cooking appliance apparatus of claim 1, wherein the at least one control signal is a pulse width modulated signal.

9. The cooking appliance apparatus of claim 8, wherein the at least one control signal has at least two different duty factors during the at least one switching operation.

10. The cooking appliance apparatus of claim 1, wherein the control unit is configured to increase in at least one operating state the mean coil voltage at least temporarily above a normal voltage value of the at least one driver coil.

11. A cooking appliance, comprising at least one cooking appliance apparatus said cooking appliance apparatus comprising at least one mechanical switch including at least one armature element and at least one driver coil, said at least one driver coil being configured to at least initiate at least one switching operation of the at least one armature element, at least one driver circuit configured to supply at least one mean coil voltage for the at least one driver coil, and a control unit configured to supply at least one control signal for controlling the at least one driver circuit, said control unit being configured to divide the at least one switching operation into at least one first time subrange and at least one second time subrange and to operate the at least one driver coil differently via the at least one driver circuit in the at least first and second time subranges, wherein the at least one armature element bounces between an open state and a closed state a plurality of times in the at least one second time subrange.

12. The cooking appliance of claim 11, wherein the at least one second time subrange follows the at least one first time subrange directly from a time perspective.

13. The cooking appliance of claim 11, wherein the at least one first time subrange includes at least one acceleration of the at least one armature element.

14. The cooking appliance of claim 11, wherein the control unit is configured to operate the at least one driver coil in the at least one first time subrange with a mean coil voltage which is higher than a mean coil voltage in the at least one second time subrange.

15. The cooking appliance of claim 11, wherein the at least one driver circuit has a voltage supply unit for supplying the at least one driver coil, said control unit being configured to vary in at least one operating state at least one output voltage of the voltage supply unit.

16. The cooking appliance of claim 15, wherein the voltage supply unit has at least one DC converter.

17. The cooking appliance of claim 11, wherein the at least one control signal is a pulse width modulated signal.

18. The cooking appliance of claim 17, wherein the at least one control signal has at least two different duty factors during the at least one switching operation.

19. The cooking appliance of claim 11, wherein the control unit is configured to increase in at least one operating state the mean coil voltage at least temporarily above a normal voltage value of the at least one driver coil.

20. A method for operating a cooking appliance apparatus having at least one mechanical switch and at least one driver circuit, said method comprising:

initiating at least one switching operation of at least one armature element of the at least one mechanical switch by at least one driver coil of the at least one mechanical switch;

dividing the at least one switching operation into at least one first time subrange and at least one second time subrange; and operating the at least one driver coil differently via the at least one driver circuit in the first and second time subranges, with the at least one driver circuit supplying at least one mean coil voltage for the at least one driver coil, wherein the at least one armature element bounces between an open state and a closed state a plurality of times in the at least one second time subrange.

21. The method for claim 20 for operating a cooktop apparatus.

* * * * *